US006640354B2

(12) United States Patent
Bonack et al.

(10) Patent No.: US 6,640,354 B2
(45) Date of Patent: Nov. 4, 2003

(54) REMOVABLE SHOWER SEAT

(75) Inventors: Paul A. Bonack, Plymouth, WI (US); Jason R. Miller, Elkhart Lake, WI (US); Jason T. Lanius, Sheboygan, WI (US); Kevin L. Witt, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/071,783

(22) Filed: Feb. 7, 2002

(65) Prior Publication Data

US 2003/0145376 A1 Aug. 7, 2003

(51) Int. Cl.[7] ..... A47K 3/12
(52) U.S. Cl. ..... 4/611; 4/578.1
(58) Field of Search ..... 4/578.1, 579, 611; 297/217.1, 217.7; 52/27.5, 79.1; 108/42; 211/90.01; 248/220.1

(56) References Cited

U.S. PATENT DOCUMENTS 2,219,975 A * 10/1940 Bentz ..... 248/220.1
2,340,545 A * 2/1944 Marsh ..... 248/220.1 X
3,193,848 A 7/1965 Levy
4,987,619 A 1/1991 Smith
5,090,068 A 2/1992 Zellner
5,542,218 A 8/1996 Rompel
5,732,421 A 3/1998 Scherberger
6,301,725 B1 10/2001 Harvev

OTHER PUBLICATIONS

An Eljer ad entitled "Rutger Shower", undated, admitted prior art.

A Kohler Co. ad entitled "Freewill", undated, admitted prior art.

* cited by examiner

*Primary Examiner*—Charles E. Phillips
(74) *Attorney, Agent, or Firm*—Quarles & Brady LLP

(57) ABSTRACT

Disclosed is a removable shower seat for use in a modular shower. The seat is constructed from a plastic material and includes an elastomer coating which is molded onto the plastic substrate. The shower seat mounts to shower module wall pockets at each end, and is further supported at the rear and front corners.

7 Claims, 8 Drawing Sheets

REMOVABLE SHOWER SEAT

CROSS-REFERENCE TO RELATED APPLICATION

Not applicable.

STATEMENT OF FEDERALLY SPONSORED RESEARCH/DEVELOPMENT

Not applicable.

BACKGROUND OF THE INVENTION

The present invention relates to shower enclosures and the like. More specifically it relates to support structures provided near corners of such enclosures, and seats for use therewith.

There are occasions when almost any bather may want to be able to sit at normal chair height in a shower enclosure (e.g. to wash feet). Also, the elderly, the handicapped, and certain children often need or desire to be able to sit at normal chair height when showering.

While the largest shower enclosures can provide enough room to install integral (or permanently affixed) seat structures (see e.g. U.S. Pat. No. 6,301,725), some shower enclosures are 48 inches wide or less. For these, it may be undesirable to take up so much room with seats that will always jut out into the standing space. Thus, some enclosures are provided with fold-up seats. However, these types of seats require additional construction and assembly, and risk additional leakage points along the attachment holes.

In connection with bathtubs there have been a variety of removable seats provided that are suspended on opposed front and back walls of the tub. When the bather wishes to sit all the way in the tub, the seat is simply removed. However, this requires there to be a front wall opposed to the rear wall.

For more conventional shower enclosures which do not have a raised front wall, it is more conventional to use the approach of attaching corner seats with fasteners. See U.S. Pat. Nos. 5,542,218 and 5,732,421.

Yet another approach is that of U.S. Pat. No. 3,193,848 which describes a self-standing stool with legs that permit it to be positioned at a corner and temporarily coupled to the corner with suction cups. However, this is not a secure attachment system.

There have also been suggestions to provide a shower enclosure that has at both its left and its right corners pedestals that can be used to somewhat support a removable seat. However, this system did not securely attach the seat without fasteners in situations where most of the weight is at the front of the seat.

Thus, a need still exists for the development of a removable shower seat which can be easily positioned in or removed from a shower module without the use of fasteners, yet which is securely supported.

BRIEF SUMMARY OF THE INVENTION

The present invention provides a combined bathing enclosure and removable seat. The bathing enclosure has (i) a rear wall, (ii) opposed side walls, (iii) a support positioned adjacent a corner of the enclosure, where the corner is defined by a junction between the rear wall and a specified one of said side walls, (iv) a first pocket along the rear wall adjacent the support, and (v) a second pocket along the specified side wall adjacent the support. For purposes of this application, the term "bathing enclosure" is intended to cover any enclosure suitable for bathing, regardless of whether fully enclosed (e.g. a three-sided structure), and regardless of whether having a bathtub for also permitting reclined bathing (e.g. a shower enclosure). There is also a seat removably supportable adjacent the corner with one end of the seat positionable in the first pocket and an opposite end of the seat positionable in the second pocket.

In preferred forms at least one of the pockets has a downwardly sloped surface, and the seat has a surface that can rest on that sloped surface. The rear wall of the enclosure has a ledge adjacent the first pocket opposite the support, and the seat has a flange suitable to rest on that ledge. Also, the specified side wall of the enclosure can have a ledge adjacent the second pocket opposite the support, and the seat can have a wall suitable to rest on that ledge.

Further, the seat can have on its top surface a front edge, a left edge, a right edge, and a rear edge, with the left and right edges being essentially perpendicular to each other. In yet other forms the seat is formed of a base material that is at least partially coated with an elastomer along surfaces that can contact the bathing enclosure when the seat is installed therein.

In accordance with the present invention, the seat can be installed without fasteners, and thus can be removed without marring the shower stall, for cleaning, for when a user wishes to use the shower without a seat, and for when the seat is to be moved to the opposite corner.

The seat is supported on three sides, and on its opposite ends is also supported in angled pockets. Thus, the seat can support substantial weight without tipping, even though it is not bolted to the wall or supported along the front wall.

These and other advantages of the present invention will be apparent from the description that follows. The claims should be looked to in order to judge the full scope of the invention.

DETAILED DESCRIPTION OF THE INVENTION

Figure 1:
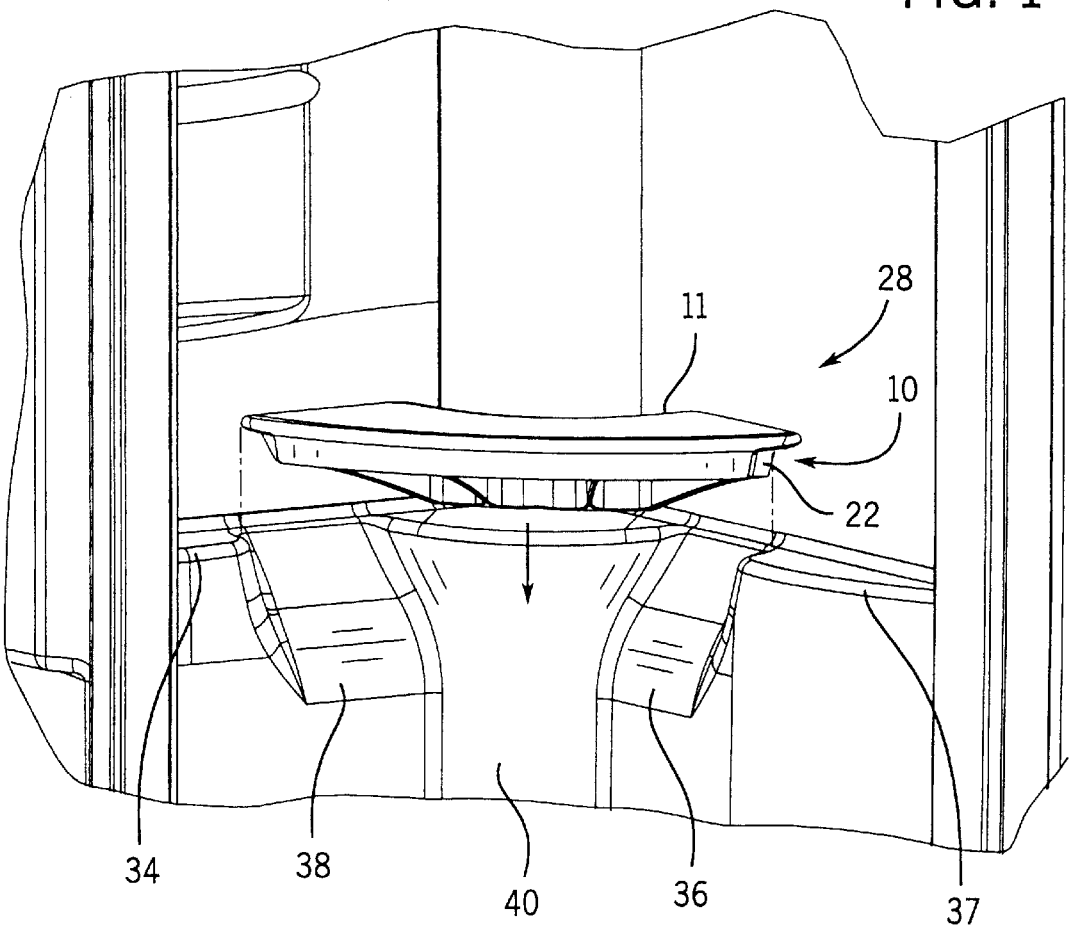
FIG. 1 is left, frontal, upper perspective of part of a shower enclosure having a seat structure constructed in accordance with the present invention.

A removable shower seat 10 that is constructed in accordance with the present invention is shown in FIG. 1 in the process of being installed in a shower enclosure module 28. The shower seat 10 preferably has a planar top 11 that is contoured trapezoidal. The top is supported by a base section 22 which is sized and dimensioned to be wedged against and into pockets 36 and 38 of the module 28, as described more fully below.

Figure 2:
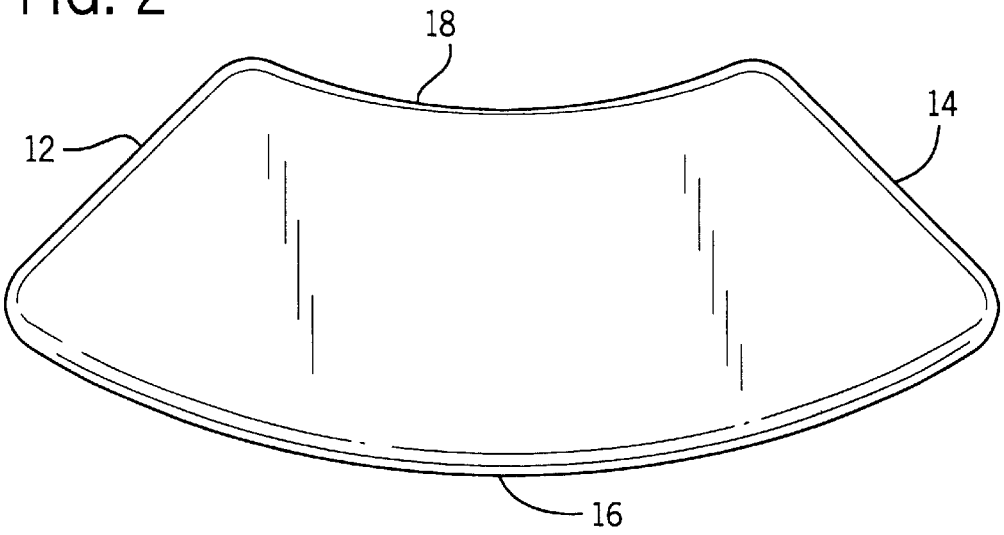
FIG. 2 is a top plan view of the seat of FIG. 1.

Referring now to FIG. 2, the seat has right and left side edges 12 and 14, a front edge 16, and a rear edge 18. The right and left side edges 12 and 14 are directed in planes substantially perpendicular to each other. The front edge 16 and back edge 18 extend between the side walls 12 and 14 substantially parallel to each other. Preferably, the front and back edges 16 and 18 are curved, as shown.

Figure 4:
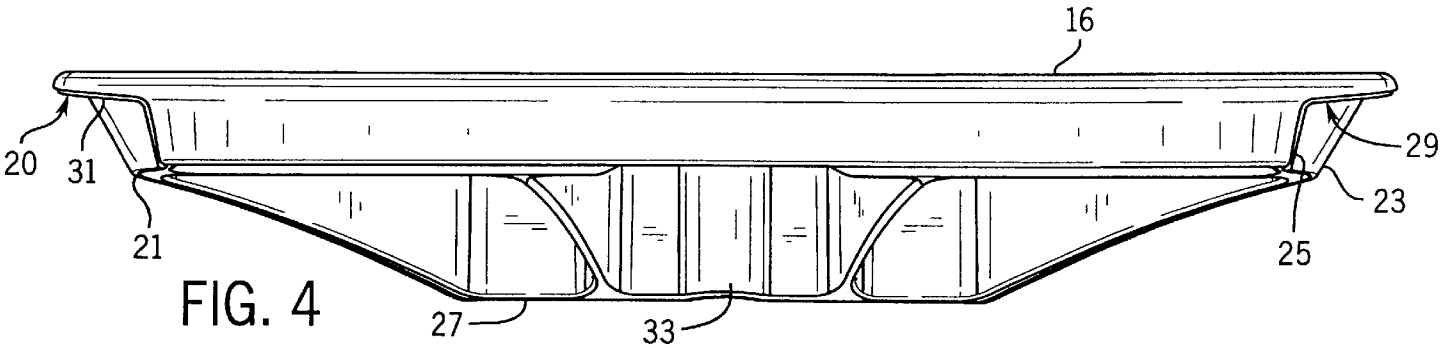
FIG. 4 is a front elevational view of the seat of FIG. 2.
Figure 5:
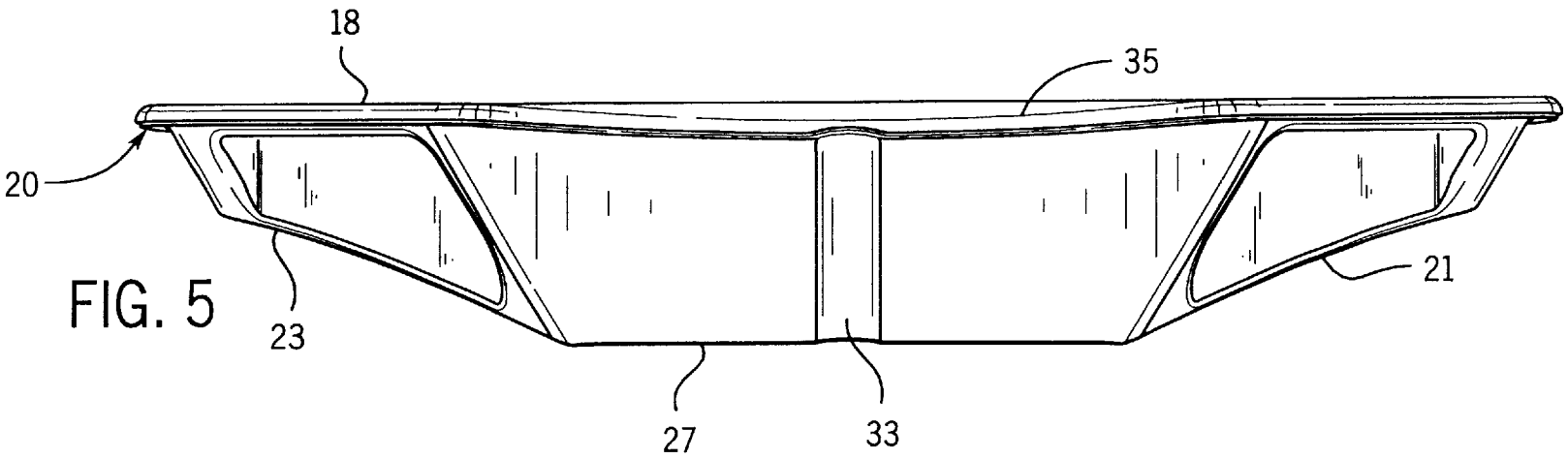
FIG. 5 is a rear elevational view of the seat of FIG. 2.
Figure 6:
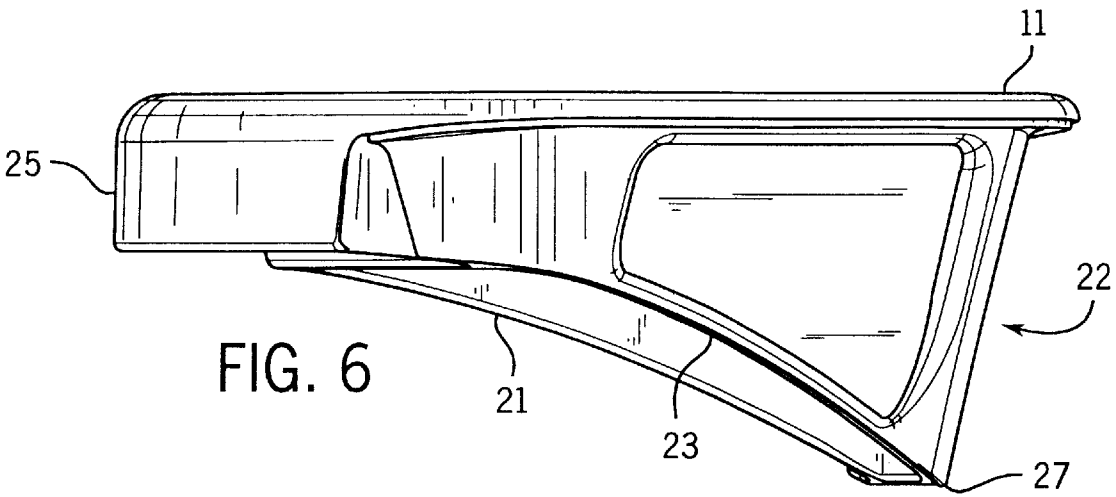
FIG. 6 is a right side view of the seat of FIG. 2.

The base section 22 has left and right side walls 21 and 23, respectively, a front wall 25, and a rear wall 27. The walls 21, 23, 25, and 27 extend downward in direction substantially perpendicular to a horizontal plane defined by the seat top 11. The front wall 25 and front edge 16 are generally co-extensive, while the side wall 12, side wall 14, and back side wall 18 are offset from the corresponding surfaces of the seat to define a horizontally-extending flange. See also FIGS. 4–6.

Figure 3:
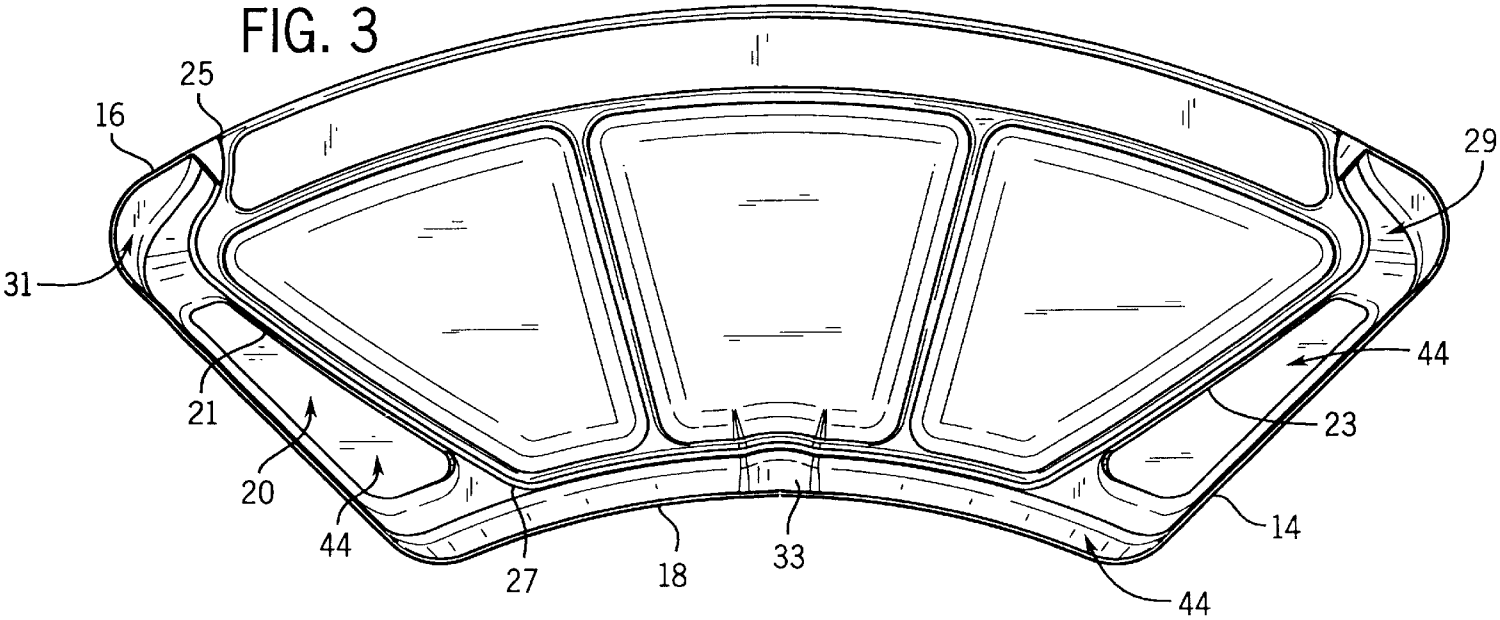
FIG. 3 is a bottom plan view of the seat of FIG. 2.

Referring now to FIG. 3, it can also be seen that the width of the flange 20 is varied to provide a wider contact surface in defined mounting locations. In particular, the side walls 21 and 23 are angled as they approach the front wall 25, thereby providing corner mounting sections 29 and 31, respectfully, at the intersection of the front and side walls.

Referring again to FIGS. 4–6, and FIG. 1, the side walls 21 and 23 are angled to mate with the angled pocket side walls (36 and 38) of the shower stall, as described more fully below. The walls 21 and 23 are angled upward from the back to the front of the seat 10. The side walls 21 and 23 are therefore highest at the intersection with the back wall 27 and lowest at the intersection with the front wall 25.

The back wall 27 has a back support which is formed to mate against the corner wall of the shower stall 28. However, a small water passage groove 33 is formed in the wall 27 to allow water to drain from both the seat 10 and the supporting region 32. The water passage area comprises an indentation 33 in the back wall 27, which operates in a conjunction with a downwardly sloping ridge 35 formed in the seat 11 to direct water.

The seat element 11 and base section 22 are preferably molded as a single piece from a relatively rigid plastic such as polypropylene material. To further provide rigidity, the base section 22 is provided with internal structural ribs.

In accordance with the present invention, a low durometer elastomer material 44 is molded onto contact surfaces along the seat 10, such as the lower side of flange 20 and the corresponding walls 21, 23, and 27. The plastic material can be polypropylene, preferably a homopolymer having a tensile strength of 4900 psi (ASTM D638) and a flexural modulus of 190,000 psi (ASTM D790). The elastomer is preferably rated at 55±5 durometer. An elastomer of this type is the Santoprene® 8211-55 series available from Advanced Elastomer Systems of Akron, Ohio.

It will be particularly appreciated that the flexibility of the surface should be greater than the flexibility of the shower module walls. This will assist in avoiding having the seat scratch the wall surfaces. The flexible material will also help securely wedge the seat in place.

Figure 7:
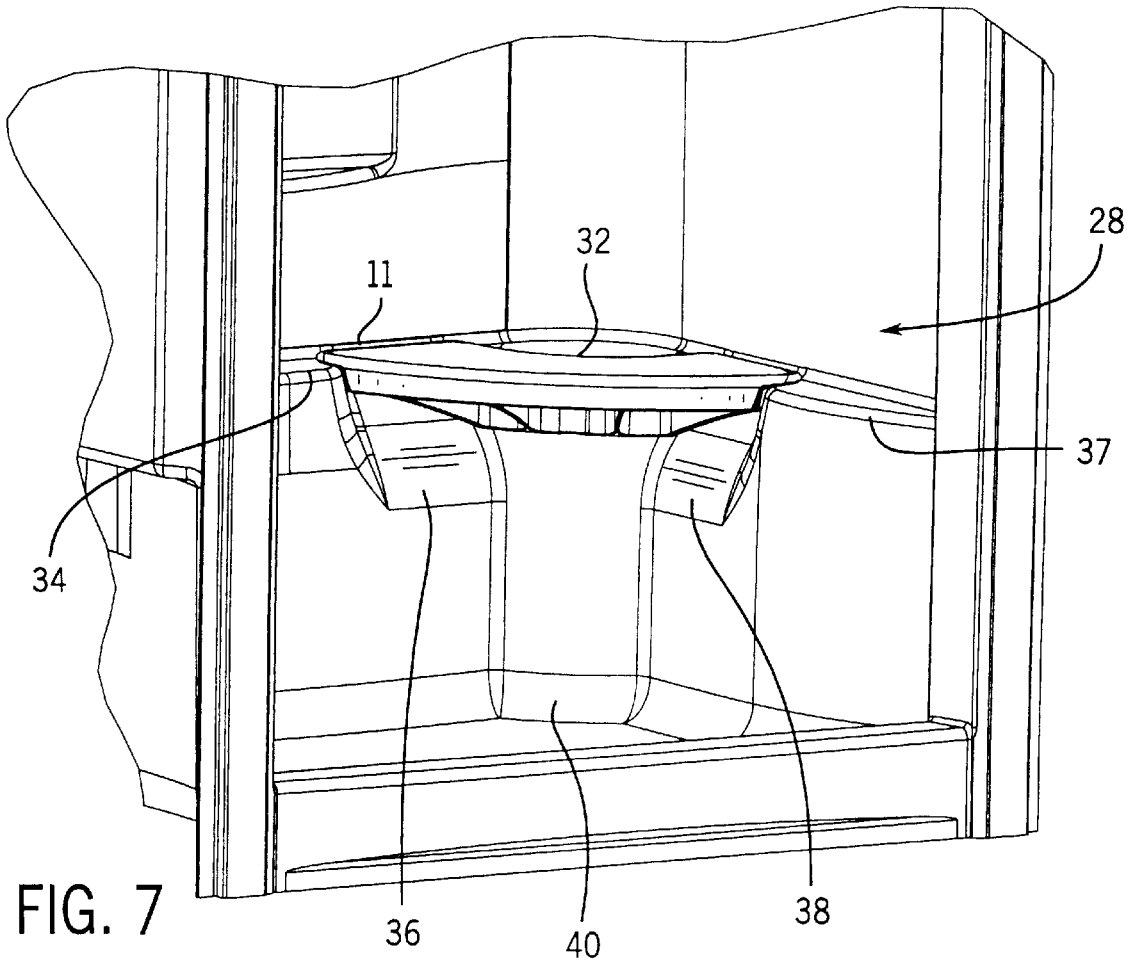
FIG. 7 is a view similar to FIG. 1, but showing somewhat more of the shower module, and showing the seat in an installed position.
Figure 8:
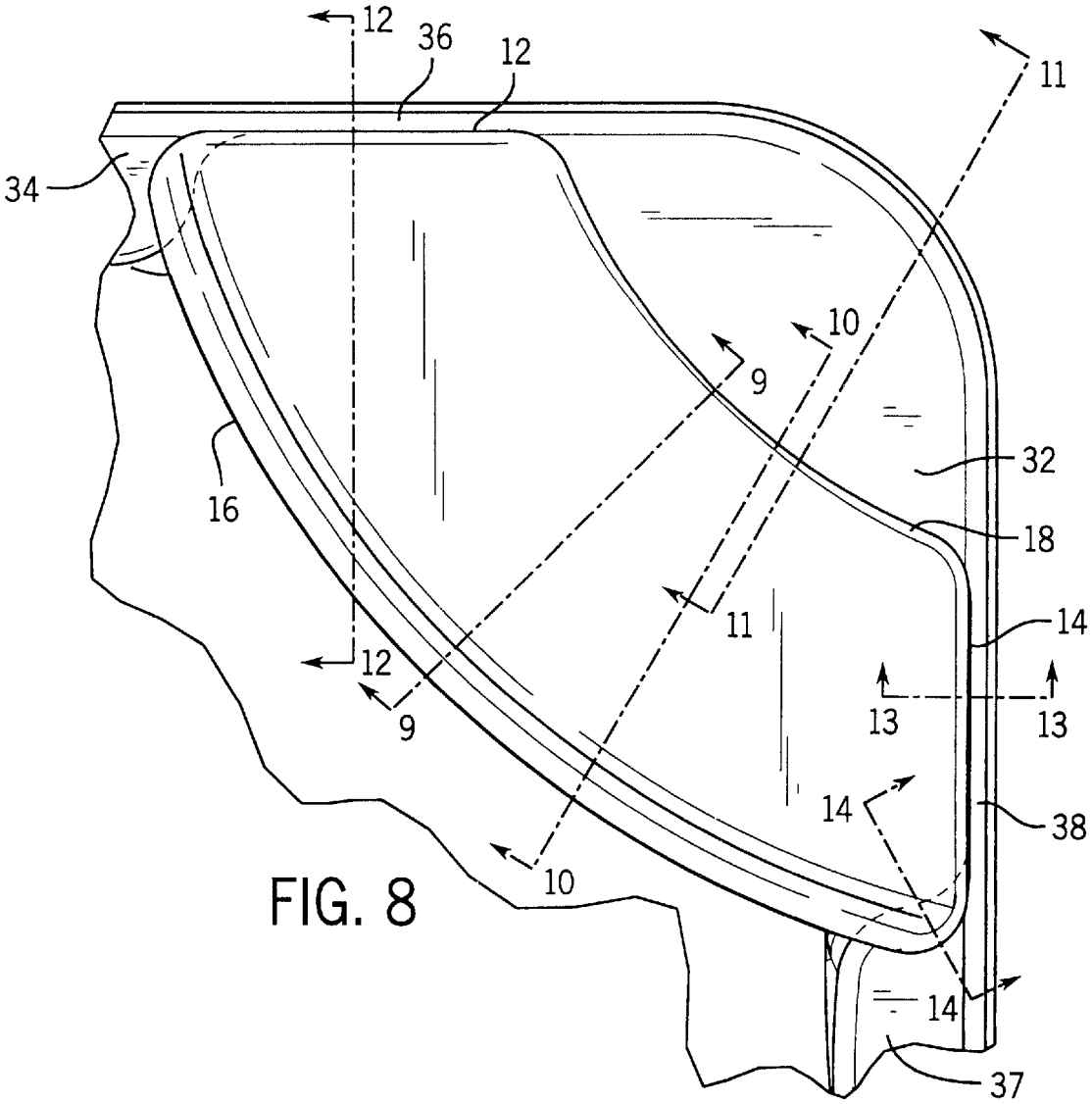
FIG. 8 is a top plan view of a part of the FIG. 7 assembly.

Referring now to FIGS. 1 and 7, the shower stall module 28 has pockets 36 and 38. There is also a corner pedestal 32 above a support 40. A similar construction is provided at the left rear corner of the shower stall to provide the opportunity for the seat to alternatively be mounted at that corner. The pockets have outwardly and downwardly sloping side walls, and opposed end walls. Along the rear wall of the module is a ledge 34, and along the side wall of the module is a ledge 37.

As the seat 10 is installed, the portion of the flange 20 extending horizontally from the back wall 27 of the base 22 is received on the corner pedestal 32. See also FIG. 9.

The corner mounting portions 29 and 31 of the flange 20 rest on the ledges 37 and 34. See e.g. FIG. 14. When this is achieved, both the bottom of the side walls 21 and 23 and the flange section 20 along the side walls 21 and 23 rest against the angled pocket wall sections 36 and 38, respectively. See FIG. 13. Because of all of these points of support, the seat can support a wide range of body sizes without tipping.

As noted above, all surfaces which will contact the shower stall 28 are coated with an elastomer material 44. Apart from the advantages noted above, the elastomer compresses with applied weight, thereby allowing some flex, thereby making seating more comfortable.

Figure 9:
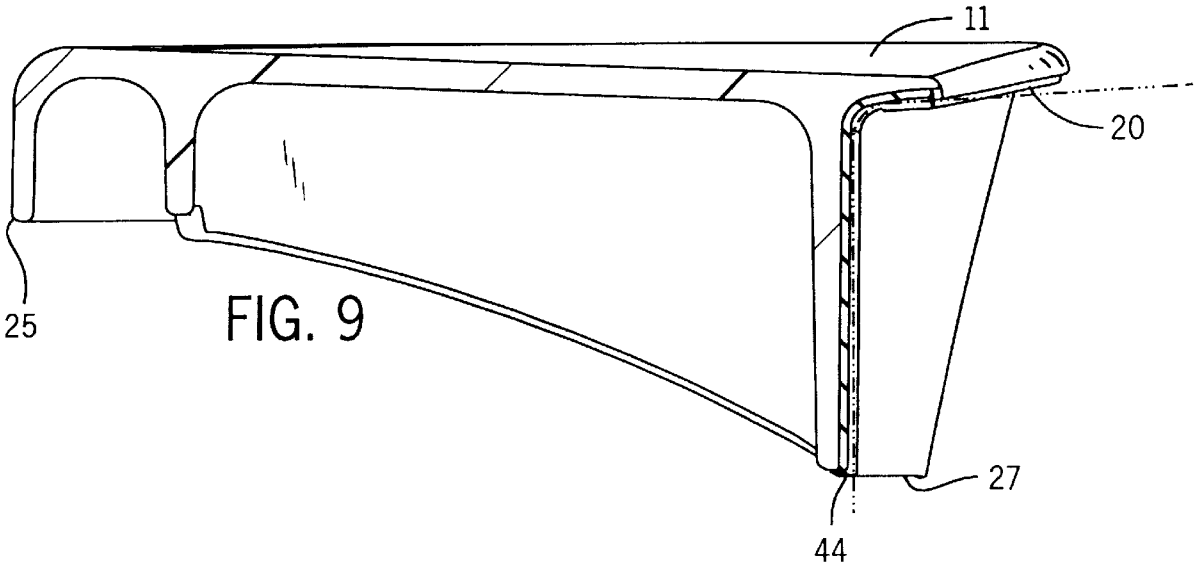
FIG. 9 is a sectional view taken along line 9—9 of FIG. 8.
Figure 10:
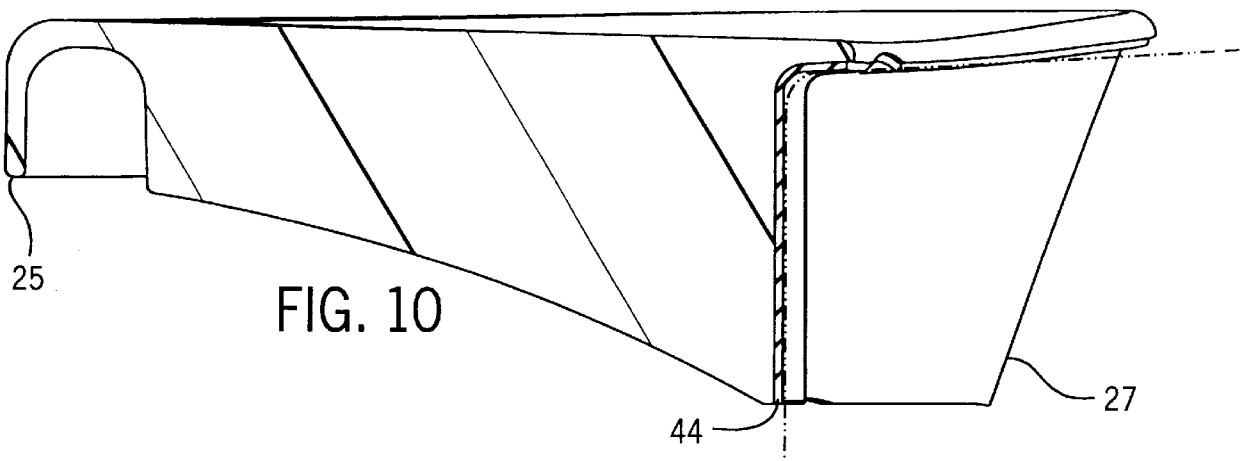
FIG. 10 is a sectional view taken along line 10—10 of FIG. 8.
Figure 11:
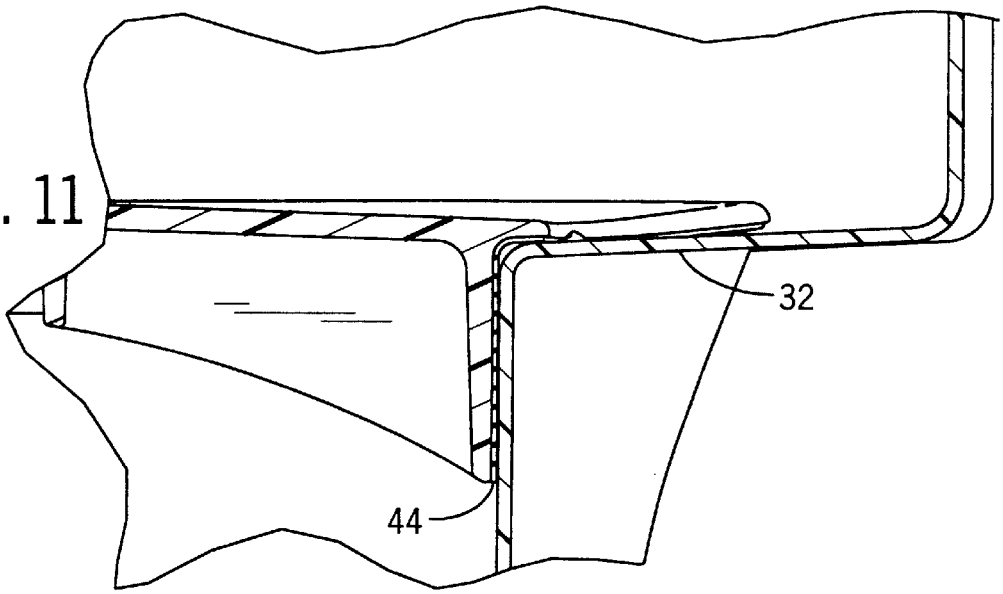
FIG. 11 is a sectional view taken along line 11—11 of FIG. 8.

Referring next specifically to FIGS. 9–11, detailed views of the back portion of the flange 20 resting on the corner pedestal 32 are shown. Note that the back wall 27 rests along the support section 40.

Figure 12:
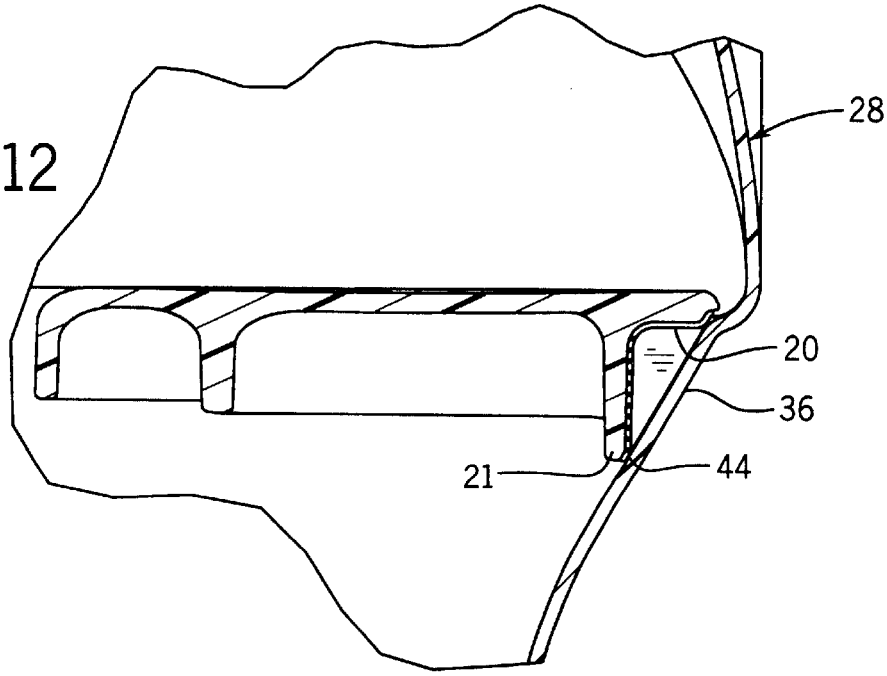
FIG. 12 is a sectional view taken along line 12—12 of FIG. 8.
Figure 13:
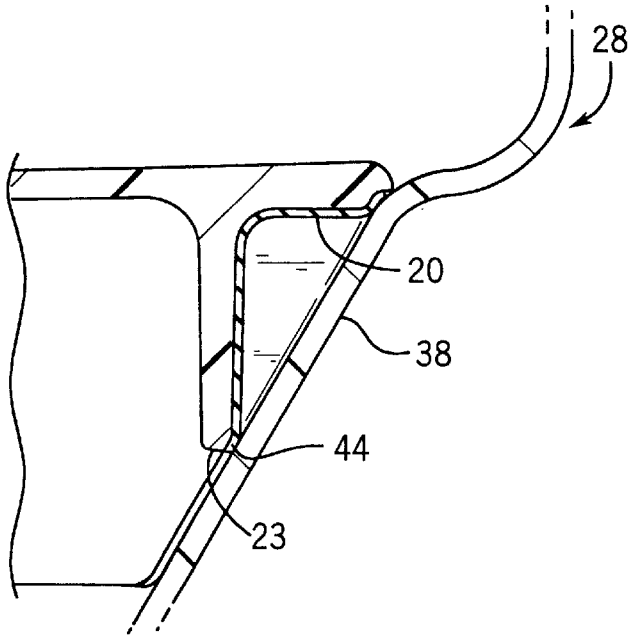
FIG. 13 is a sectional view taken along line 13—13 of FIG. 8.
Figure 14:
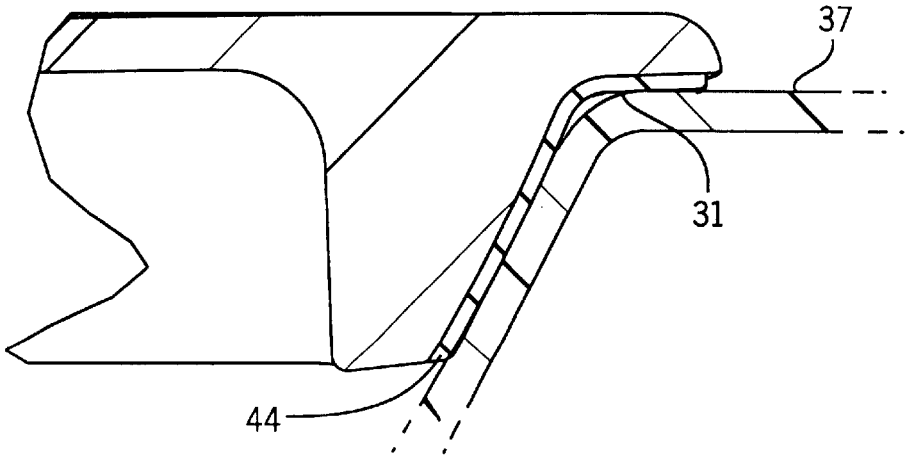
FIG. 14 is a sectional view taken along line 14—14 of FIG. 8.

Referring next to FIGS. 12 and 13, both the bottom edges of the side walls 21 and 23 and the edge of the flange 20 rests against the angled side wall 36 and 38, respectively. Referring next to FIG. 14, at the corner between each of the side and front edges of the seat, the corner portions 29, 31 of the flange 20 rests on the mounting ledges 34 or 37, respectively.

As will be apparent to those of ordinary skill in the art, a preferred embodiment of the invention has been described above. Modifications and variations to the preferred embodiment may be made within the spirit and scope of the invention. Therefore, the invention is not to be limited to the described embodiment. To ascertain the full scope of the invention, the following claims should be referenced.

Industrial Applicability

The present invention provides a shower enclosure having a removable shower seat.

We claim:

1. A combined bathing enclosure and removable seat, comprising:

a bathing enclosure having (i) a rear wall, (ii) opposed side walls, (iii) a support positioned adjacent a corner of the enclosure, where the corner is defined by a junction between the rear wall and a specified one of said side walls, (iv) a first pocket along the rear wall adjacent the support, and (v) a second pocket along the specified side wall adjacent the support; and a seat removably supportable adjacent said corner with one end of the seat positionable in the first pocket and an opposite end of the seat positionable in the second pocket;

wherein at least one of the pockets has a downwardly sloped surface, and the seat has a surface that can rest on that sloped surface; and wherein the rear wall of the enclosure has a ledge adjacent the first pocket opposite the support, and the seat has a flange suitable to rest on that ledge.

2. The combined bathing enclosure and removable seat of claim 1, wherein the bathing enclosure is a shower enclosure.

3. The combined bathing enclosure and removable seat of claim 1, wherein the seat has on its top surface a front edge, a left edge, a right edge, and a rear edge, with the left and right edges being essentially perpepdicular to each other.

4. A combined bathing enclosure and removable seat, comprising:

a bathing enclosure having (i) a rear wall, (ii) opposed enclosure side walls, (iii) a support positioned adjacent a corner of the enclosure, where the corner is defined by a junction between the rear wall and a specified one of said enclosure side walls, (iv) a first pocket along the rear wall adjacent the support, and (v) a second pocket along the specified enclosure side wall adjacent the support; and a seat removably supportable adjacent said corner with one end of the seat positionable in the first pocket and an opposite end of the seat positionable in the second pocket;

wherein the seat is installed in the pockets and is not connected by a separate fastener to the enclosure rear or side walls; and wherein the pockets both have a pocket Side wall and opposed end walls.

5. A combined bathing enclosure and removable seat, comprising:

a bathing enclosure having (i) a rear wall, (ii) opposed side walls, (iii) a support positioned adjacent a corner of the enclosure, where the corner is defined by a junction between the rear wall and a specified one of said side walls, (iv) a first pocket along the rear wall adjacent the support, and (v) a second pocket along the specified side wall adjacent the support; and a seat removably supportable adjacent said corner with one end of the seat positionable in the first pocket and an opposite end of the seat positionable in the second pocket;

wherein the specified side wall of the enclosure has a ledge adjacent the second pocket opposite the support, and the seat has a wall suitable to rest on that ledge.

6. A combined bathing enclosure and removable seat, comprising:

a bathing enclosure having (i) a rear wall, (ii) opposed side walls, (iii) a support positioned adjacent a corner of the enclosure, where the corner is defined by a junction between the rear wall and a specified one of said side walls, (iv) a first pocket along the rear wall adjacent the support, and (v) a second pocket along the specified side wall adjacent the support; and a seat removably supportable adjacent said corner with one end of the seat positionable in the first pocket and an opposite end of the seat positionable in the second pocket;

wherein the seat is formed of a base material that is at least partially coated with an elastomer along surfaces that contact the bathing enclosure when the seat is installed therein.

7. The combined bathing enclosure and removable seat of claim 6, wherein the seat is at least partially made from polypropylene.

* * * * *

UNITED STATES PATENT AND TRADEMARK OFFICE

CERTIFICATE OF CORRECTION

PATENT NO. : 6,640,354 B2
DATED : November 4, 2003
INVENTOR(S) : Paul A. Bonack et al.

It is certified that error appears in the above-identified patent and that said Letters Patent is hereby corrected as shown below:

Column 5,
Line 7, change “perpepdicular” to -- perpendicular --.
Line 26, change “Side” to -- side --.

Signed and Sealed this

Sixteenth Day of December, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,640,354 B2
DATED : November 4, 2003
INVENTOR(S) : Paul A. Bonack et al.

It is certified that error appears in the above-identified patent and that said Letters Patent is hereby corrected as shown below:

Column 5,
Line 7, change “perpepdicular” to -- perpendicular --.
Line 25, change “Side” to -- side --.

This certificate supersedes Certificate of Correction issued December 16, 2003.

Signed and Sealed this

Twenty-eighth Day of September, 2004

JON W. DUDAS
*Director of the United States Patent and Trademark Office*